US007849846B1

(12) United States Patent
Boucher

(10) Patent No.: US 7,849,846 B1
(45) Date of Patent: Dec. 14, 2010

(54) ARCHERY BOW ARMGUARD

(76) Inventor: Jeffrey L. Boucher, 17633 540th Ave., Austin, MN (US) 55912

( * ) Notice: Subject to any disclaimer, the term of this patent is extended or adjusted under 35 U.S.C. 154(b) by 455 days.

(21) Appl. No.: 11/897,044

(22) Filed: Aug. 29, 2007

(51) Int. Cl.
*F41B 5/00* (2006.01)

(52) U.S. Cl. ..... 124/86; 124/88

(58) Field of Classification Search ..... 124/23.1, 124/25.6, 86, 88
See application file for complete search history.

(56) References Cited

U.S. PATENT DOCUMENTS 5,103,798 A * 4/1992 McGraw et al. ..... 124/88
5,137,008 A * 8/1992 Taylor ..... 124/88
5,464,002 A * 11/1995 Lavoie et al. ..... 124/86
6,173,707 B1 * 1/2001 Howell et al. ..... 124/88

* cited by examiner

*Primary Examiner*—John Ricci

(57) ABSTRACT

This invention entails an armguard for mounting on an archery bow. The armguard includes a shield that extends rearward from a bow, protecting an archer's forearm from the inherent danger presented by a bowstring as it delivers an arrow to its target. A mounting plate extends perpendicularly from one end of the shield provides for fast, fail-safe mounting to the bow. The armguard is mounted to the bow by threading a stabilizer, a bolt, or other bow accessory through an aperture in the mounting plate and into the accessory port. The mounting plate can be attached to both sides of the mounting end of the shield, enabling both right-handed and left-handed use of the armguard.

12 Claims, 3 Drawing Sheets

ARCHERY BOW ARMGUARD

BACKGROUND OF THE INVENTION

1. Field of the Invention

The present invention relates to an archery bow armguard for use in connection with shooting an archery bow. The archery bow armguard has particular utility in protecting the forearm of an archer shooting an archery bow, shielding the forearm throughout the entire path of a bowstring as it drives an arrow forward.

2. Description of the Prior Art

When an archer shoots an archery bow, the bowstring tends to shear the forearm of the archer as it drives an arrow forward. Because the bowstring travels with a great amount of force, it presents a serious hazard to the archer. In fact, the bowstring can cause significant bodily harm to the archer. Additionally, a strike from the bowstring may cause the archer to move his arm, decreasing shooting accuracy. Furthermore, the archer's clothing may interfere with the bowstring, causing injury to the archer or decreased shooting accuracy.

In response to the hazards of shooting an archery bow, forearm mounted armguards have first been developed in the art. The armguards were attached to the interior of the forearm. Although these armguards shielded the archer's arm from the bowstring, they were uncomfortable and difficult to secure to the forearm. Moreover, if the archer needed to change clothing, the armguard had to be removed and resecured.

To counteract the shortcomings of forearm-mounted armguards, bow-mounted armguards were developed. The reader is directed to two U.S. patents of particular relevance: U.S. Pat. No. 5,137,008 issued Aug. 11, 1992 to Anthony Taylor; and U.S. Pat. No. 5,464,002 issued Nov. 7, 1995 to Camilien Lavoie.

U.S. Pat. No. 5,137,008 to Taylor discloses an armguard designed for integral mounting to an archery bow's frame. However, the Taylor '008 patent is crude in design. Specifically, the shape and assembly of the Taylor '008 armguard makes it possible for the bowstring to lodge itself between the armguard and the archer's forearm. For example, if the adjustable mounting plate is improperly assembled it could interfere with the path of the bowstring, increasing the probability of injury to the archer or decreasing shooting accuracy.

U.S. Pat. No. 5,464,002 to Lavoie discloses another armguard designed to be integrally mounted to an archery bow's frame. However, improper assembly or adjustment could cause interference with the path of the bowstring, increasing the probability of injury to the archer or decreasing shooting accuracy. Specifically, two points of assembly or adjustment are hazardous, the sliding member to stabilizer shaft interface and the stabilizer shaft to bow frame interface. First, there is no way to ensure the sliding member (box-like casing) is properly aligned on the stabilizer shaft. If the sliding member is not properly aligned, it is likely that the shield member will interfere with the path of the bowstring. Additionally, there is no way to ensure the sliding member will not rotate on the stabilizer shaft while the archer is shooting. If the sliding member rotates while the archer is shooting, it is likely that the shield member will interfere with the path of the bowstring. Second, there is no way to ensure that the stabilizer shaft is properly aligned with the bow frame. If the stabilizer shaft is not properly aligned with the bow frame, the shield member will likely interfere with the path of the bowstring. Although the sliding member could be adjusted to offset improper stabilizer shaft alignment, that creates a circular problem regarding alignment of the sliding member itself.

While the above-described devices fulfill their respective, particular objectives and requirements, the aforementioned patents do not describe an archery bow armguard that provides protection to an archer's arm throughout the path of a bowstring. Therefore, a need exists for a new and improved archery bow armguard that can be used for protection to an archer's arm throughout the path of a bowstring. In this regard, the present invention substantially fulfills this need. In this respect, the archery bow armguard according to the present invention substantially departs from the conventional concepts and designs of the prior art, and in doing so provides an apparatus primarily developed for the purpose of protecting an archer's arm throughout the path of a bowstring.

SUMMARY OF THE INVENTION

In view of the foregoing disadvantages inherent in the known types of archery armguards now present in the prior art, the present invention provides an improved archery bow armguard, and overcomes the above-mentioned disadvantages and drawbacks of the prior art. As such, the general purpose of the present invention, which will subsequently be described in greater detail, is to provide a new and improved archery bow armguard which has all the advantages of the prior art mentioned heretofore and many novel features that result in a archery bow armguard that is not anticipated, rendered obvious, suggested, or even implied by the prior art, either alone or in any combination thereof.

To attain this, the present invention essentially comprises a shield designed to prevent a bowstring from striking an archer's forearm as he shoots an archery bow. Moreover, the shield includes a curved deflection lip that extends over the archer's forearm. Thus, the shield provides coverage for the archer's entire forearm. Additionally, the shield can be adjusted for left-handed and right-handed archers and its position can be adjusted with respect to the bow.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved archery bow armguard that has all of the advantages of the prior art armguards and none of the disadvantages.

It is another object of the present invention to provide a new and improved archery bow armguard that may be easily and efficiently manufactured.

Still another object of the present invention is to provide a new archery bow armguard that protects an archer's forearm throughout the entire path of a bowstring as it delivers an arrow to its target.

A further object of the present invention is to provide archery bow armguard that is simple to mount and safeguards against improper mounting. Safeguarded mounting allows the archer to insure that the armguard is properly attached to the bow at all times. This eliminates the likelihood of injury from improper assembly that existed in the prior art.

Another important object of the invention is that the armguard is designed to fit the archer by being adjustable.

The objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
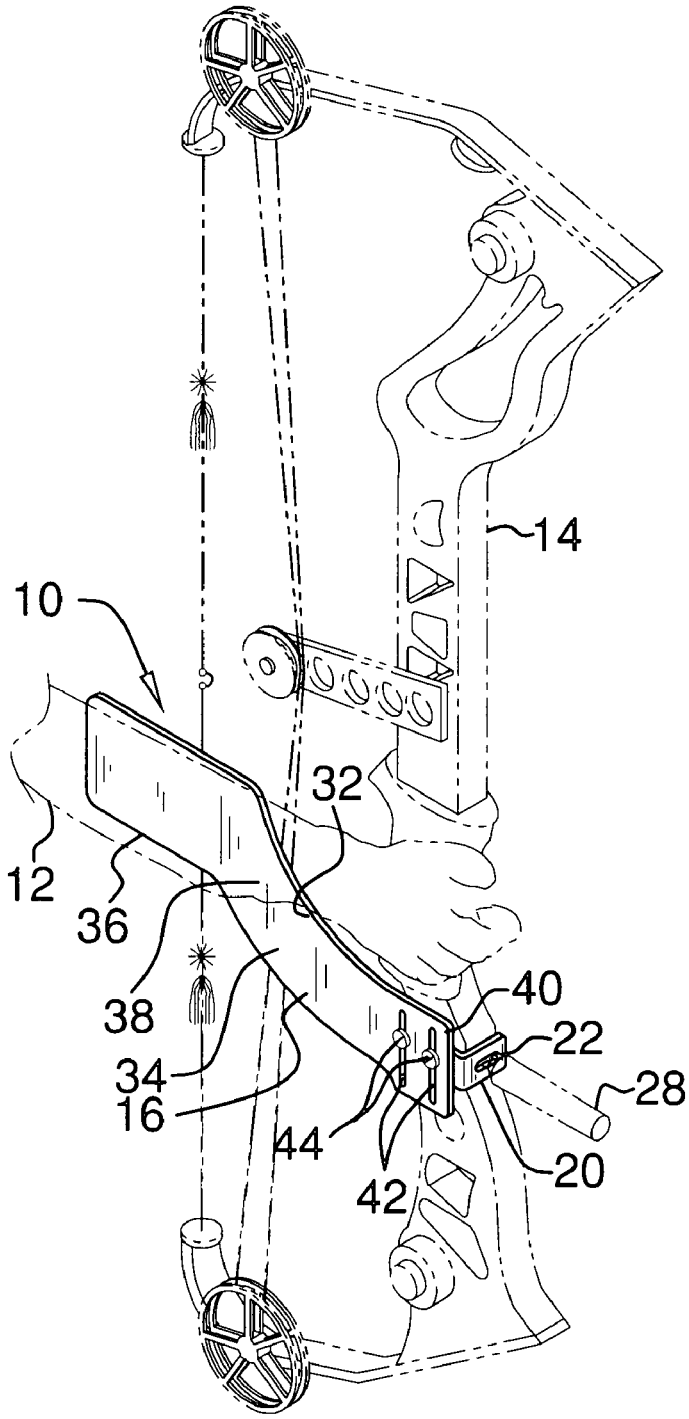
FIG. 1 is a right perspective view of the preferred embodiment of the archery bow armguard as mounted on an archery bow, further showing in phantom lines an archery bow and an arm holding the archery how.

Referring now to the drawings, and particularly to FIGS. 1-4, a preferred embodiment of the archery bow armguard ("armguard") of the present invention is shown and generally designated by the reference numeral 10. FIG. 1 provides a right perspective view of the preferred embodiment of the armguard 10 as mounted on a bow 14, further showing in phantom lines a bow 14 with a stabilizer 28 and an arm 12 holding the bow 14. As illustrated in FIG. 1, the armguard comprises a shield 16 that extends backwards from the bow 14 and covers the archer's arm 12. Moreover, the shield comprises an elongated, full panel with a supporting end 36, a midsection 38, and a mounting end 40. Furthermore, the shield's midsection 38 is located at the middle of its elongated portion. The midsection 38 has an arcuate shape, with a concave top side 32 and a convex bottom side 34. The mounting end 40 has two adjustments slots 42. An adjustment bolt 44 is inserted through each of the adjustments slots 42 to slidably attach mounting plate 20 to mounting end 40. The adjustment bolts 44 and adjustments slots 42 enable the shield 14 to be adjusted upward and downward with respect to the bow 14. Securing the mounting plate 20 on the opposite side of mounting end 40 from that depicted in FIG. 1 enables the armguard 10 to be used by a right-handed archer. The mounting plate 20 has an aperture 22 that is sized and dimensioned for reception of a stabilizer 28. If a stabilizer 28 is not used, then a bolt may be used in its place. The aperture 22 is a slot that permits the shield 16 to be adjusted closer in or further away from the bow 14. The shield 16 of the new and improved armguard 10 improves protection of the archer's arm 12 throughout the path a bowstring as it delivers an arrow to a target and permits fail-safe use.

Figure 2:
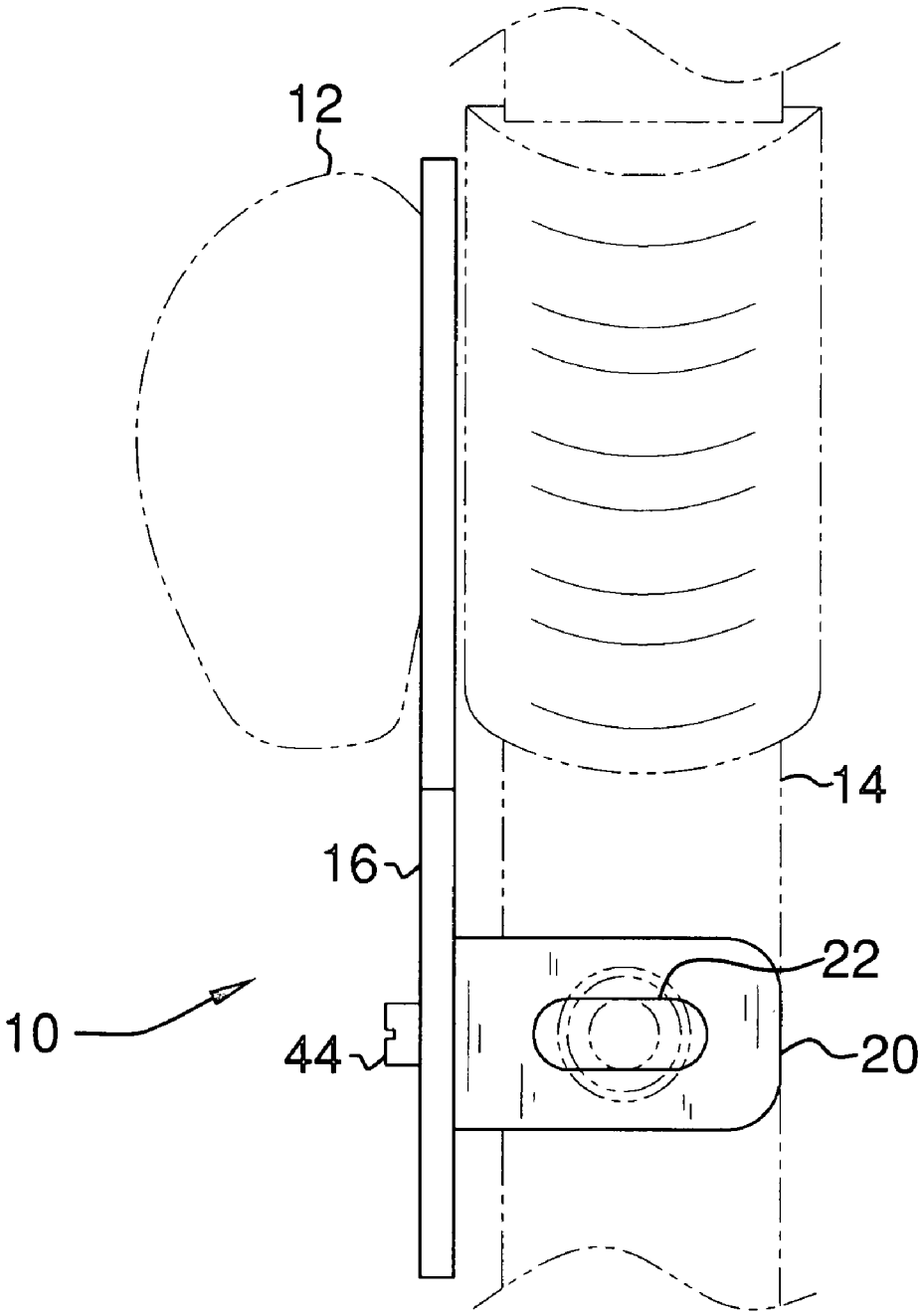
FIG. 2 is a front elevational view of the archery bow armguard with a broken portion of the bow frame and an arm shown in phantom lines.
Figure 4:
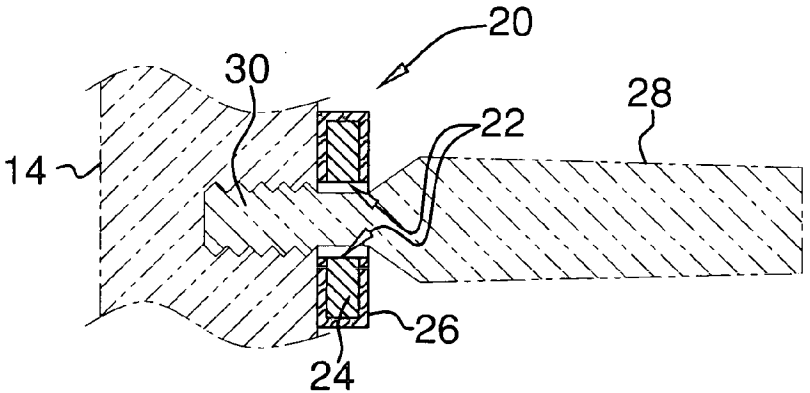
FIG. 4 is a side sectional view of the archery bow armguard, further showing side sectional views of a broken portion of the bow frame and a stabilizer in phantom lines. The same reference numerals refer to the same parts throughout the various figures.

FIG. 2 provides a front elevational view of the armguard 10 that better illustrates its intricacies. As illustrated in FIG. 2, the mounting plate 20 extends perpendicularly from the shield's mounting end 40 where it is attached by adjustment bolt 44. The mounting plate 20 has an aperture 22 that is sized and dimensioned for reception of a stabilizer 28. The stabilizer 28 runs through the mounting plate 20 and screws into the bow's accessory port 30, fastening the armguard 10 to the bow 14 (FIG. 4). To unfasten the armguard 10 from the bow 14, the archer simply unscrews the stabilizer 28 from the accessory port 30.

Figure 3:
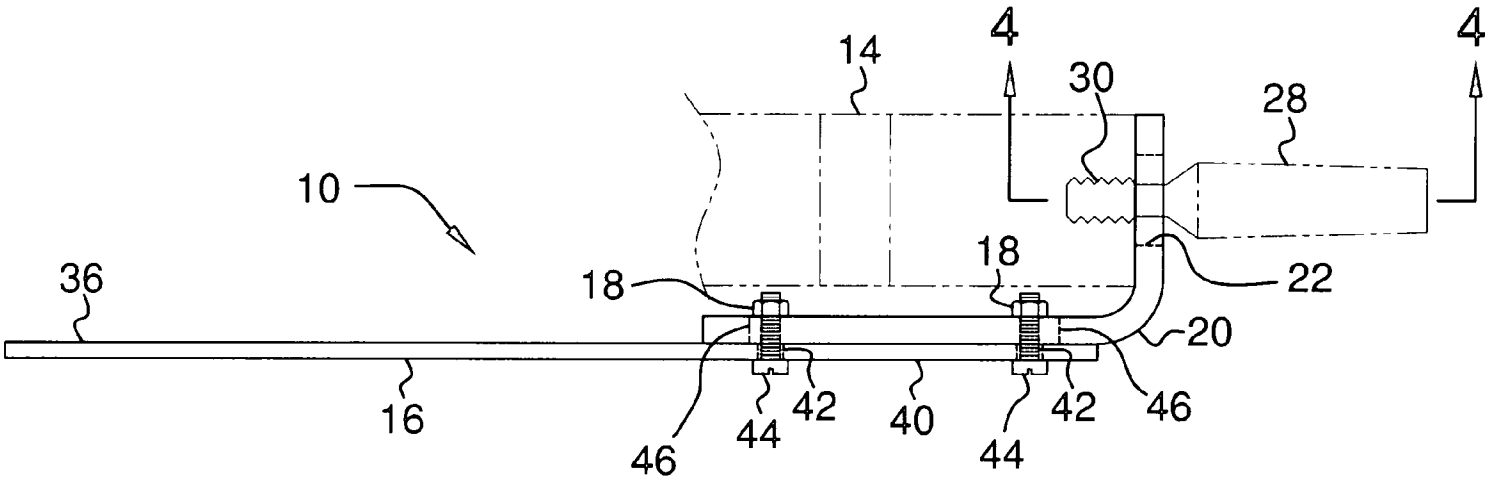
FIG. 3 is a top plan view of the archery bow armguard, further showing in phantom lines an archery bow and a stabilizer.

FIG. 3 is a top plan view of the archery bow armguard, further showing in phantom lines an archery bow and a stabilizer. The mounting plate 20 has one end secured to the mounting end 40 of the shield 16 by adjustment bolts 44 that are inserted through adjustment slots 42 in mounting and 40 and mounting plate slots 46 in mounting plate 20 and releasably secured by adjustment nuts 18. Mounting plate slots 46 are larger than adjustment bolts 44, which enables the shield 14 to be adjusted forward and backward with respect to the bow 14. The opposing end of the mounting plate 20 is releasably secured to bow 14 by stabilizer 28, which is screwed into accessory port 30. In the preferred embodiment, the shield 16 is fifteen inches long.

FIG. 4 is a side sectional view of the archery bow armguard, further showing side sectional views of a broken portion of the bow frame and a stabilizer in phantom lines. As shown in FIG. 4, the preferred embodiment includes an integrated rubber coating 26 covering an aluminum base 24. The rubber coating 26 covers the entire armguard 10. While the aluminum base 24 permits a light-weight, rigid armguard 10, the rubber coating 26 provides the archer with a comforting feel. Additionally, the rubber coating 26 protects against wear on the armguard 10. The stabilizer 28 is shown screwed into accessory port 30 through the aperture 22 in mounting plate 20.

While a preferred embodiment of the archery bow armguard has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, a stabilizer is not required to mount the armguard to the how. Instead, the armguard may be mounted by threading a bolt or a threaded bow accessory through the aperture in the mounting plate and into the accessory port. Additionally, any suitable sturdy material such as metal, plastic, or a variety of wood may be used instead of the aluminum base described. Furthermore, the rubber coating may be made of any suitable type of rubber.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An armguard for mounting on an archery bow, comprising:

a shield comprising an elongated, full panel, a midsection located at the middle of the elongated portion of the shield, a supporting end, and a mounting end;

a mounting plate extending perpendicularly from the mounting end of the shield, said mounting plate having an aperture;

a plurality of adjustment slots, wherein the mounting end of said shield defines slots therein to comprise the adjustment slots;

a plurality of mounting plate slots, wherein the mounting plate defines slots therein to comprise the mounting plate slots;

a plurality of adjustment bolts having opposing ends with one end inserted through the adjustment slots and the mounting plate slots; and a plurality of adjustment nuts threadedly attached to the end inserted through the adjustment slots of the adjustment bolts.

2. The armguard of claim 1, wherein the aperture of the mounting plate is a slot.

3. The armguard of claim 2, further comprising:

a rubber coating fixed to the shield and mounting plate.

4. The armguard of claim 3, wherein the shield measures fifteen inches long.

5. An armguard for mounting on an archery bow, comprising:

a shield comprising an elongated full panel, a midsection located at the middle of the elongated portion of the shield, a supporting end, and a mounting end with a mounting plate defining an aperture therein;

a plurality of adjustment slots, wherein the mounting end of said shield defines slots therein to comprise the adjustment slots;

a plurality of mounting plate slots, wherein the mounting plate defines slots therein to comprise mounting plate slots;

a plurality of adjustment bolts having opposing ends with one end inserted through the adjustment slots and the mounting plate slots; and a plurality of adjustment nuts threadedly attached to the ends of the adjustment bolts inserted through the adjustment slots.

6. The armguard of claim 5, wherein the midsection is arcuate in shape with a concave top side and a convex bottom side.

7. The armguard of claim 6, further comprising:

a rubber coating fixed to the shield.

8. The armguard of claim 7, wherein the shield measures fifteen inches long.

9. An armguard for mounting on an archery bow, comprising:

a shield comprising an elongated, full panel, a midsection located at the middle of the elongated portion of the shield, a supporting end, and a mounting end;

a mounting plate extending perpendicularly from the mounting end of the shield, said mounting plate having an aperture;

a plurality of adjustment slots, wherein the mounting end of said shield defines slots therein to comprise the adjustment slots;

a plurality of mounting plate slots, wherein the mounting plate defines slots therein to comprise the mounting plate slots;

a plurality of adjustment bolts having opposing ends with one end inserted through the adjustment slots and the mounting plate slots; and a plurality of adjustment nuts threadedly attached to the end inserted through the adjustment slots of the adjustment bolts.

10. The armguard of claim 9 wherein the aperture in the mounting plate is a slot shaped and dimensioned for reception of an archery bow accessory from the group consisting of bolts and stabilizers.

11. The armguard of claim 10, further comprising:

a rubber coating fixed to the shield and mounting plate.

12. The armguard of claim 11, wherein the shield measures fifteen inches long.

* * * * *